United States Patent [19]

Norman

[11] Patent Number: 4,470,372

[45] Date of Patent: Sep. 11, 1984

[54] ANIMAL (HORSE) CONFINING STALL

[76] Inventor: David L. Norman, R.R. 5, Box 237, Lawrence, Kans. 66044

[21] Appl. No.: 454,953

[22] Filed: Dec. 30, 1982

[51] Int. Cl.[3] ..... A61D 3/00

[52] U.S. Cl. ..... 119/27; 119/98

[58] Field of Search ..... 119/98, 99, 100, 101, 119/102, 103, 20, 27

[56] References Cited

U.S. PATENT DOCUMENTS

| | | | |
|---|---|---|---|
| 551,287 | 12/1895 | Jessen | 119/98 |
| 1,182,828 | 5/1916 | Winans | 119/98 |
| 2,764,127 | 9/1956 | Newman | 119/20 |
| 2,787,982 | 4/1957 | Cedeberg | 119/98 |
| 4,201,158 | 5/1980 | Parker | 119/98 |
| 4,244,324 | 1/1981 | Kratky | 119/98 |

*Primary Examiner*—Gene Mancene
*Assistant Examiner*—Kris R. Schulze
*Attorney, Agent, or Firm*—Thomas M. Scofield

[57] ABSTRACT

Improvements in animal confining and holding devices, such particularly adapted to farm animals and most particularly to horses; an improved horse chute for receiving, holding, confining and effectively immobilizing a horse for trimming, washing, treating, palpating, worming and the like.

14 Claims, 13 Drawing Figures

ANIMAL (HORSE) CONFINING STALL

BACKGROUND OF THE INVENTION

Stalls, pens and chutes are well known for receiving, confining and holding farm animals for various purposes. Examples of such for general background information include stalls for milking cows, rodeo stalls for receiving horses and bulls prior to release in riding contests, feeding stalls for various animals, resting compartments, sow farrowing boxes and the like. Restrictive stalls and chutes for individually feeding pigs and hogs are conventional. Devices are also known for holding an effectively immobilizing horses for veterinary treatment or owner horse handling and the like. In the latter case, typical uses and purposes include trimming, washing, treating, palpating, worming and grooming. Consideration must be given and taken with respect to both the animal and the owner, vet or operator. What is desired is efficient operation and convenience on initial confinement, holding and release for both, with effective one person operation and total consideration taken for the safety of both the horse and handler at all stages of the operation.

THE PRIOR ART

Applicant is aware of the following patents directed to various animal control stalls, pens, compartments, boxes and the like:

Schmidt U.S. Pat. No. 756,716 "Horse Stall" issued Apr. 5, 1904;

Ferris U.S. Pat. No. 2,688,309 "Milking Parlor Stall", issued Sept. 7, 1954;

Arnold U.S. Pat. No. 2,714,367 "Animal Pen Structure", issued Aug. 2, 1955;

Ferris U.S. Pat. No. 2,904,002 "Parlor Stall for . . . Cattle", issued Sept. 15, 1959;

Jorgensen, Jr., U.S. Pat. No. 3,127,871 "Individual Resting Compartments For Animals", issued Apr. 7, 1964;

Martensson et al U.S. Pat. No. 3,413,711 "Sow's Farrow Box", issued Nov. 26, 1968 and Van Schoyck U.S. Pat. No. 3,921,350 issued Nov. 25, 1975 for "Method And Apparatus For Providing . . . Flooring System".

Applicant is further aware of the horse handling stall designated "The Big Iron Horse" of Scranton Manufacturing, Inc. of P. O. Box 336 H, Scranton, Iowa 51462.

OBJECTS OF THE INVENTION

A first ofject of the invention is to provide a new, novel and extremely useful horse chute, such particularly constructed and effective for extreme safety and convenience in horse handling.

Another object of the invention is to provide such an improved horse handling chute which is effectively designed for and useable in one person operation with complete, effective and total consideration given to the safety of both the horse and handler.

Another object of the invention is to provide such an improved horse handling chute or stall which is effectively portable and thus available for use in the field or, alternatively, may be fixedly bolted to a cement pad.

Yet another object of the invention is to provide an improved horse handling stall, pen or chute which is openable at each end thereof and, as well, has one entire side thereof completely pivotable from one end and openable at any angle up to 90°, whereby to give full and maximum access for handling, holding, inserting and removing a horse therefrom.

Another object of the invention is to provide such an improved horse handling chute having provided therewith a unique strapping system including a double tether in front and an adjustable wither strap tiedown, both of which attach quickly and securely and are easily removable with effective holding and securement of the animal provided thereby in conjunction with the stall structure.

Still another object of the invention is to provide such an animal and horse handling stall, pen and chute with many advantages, the device additionally being of minimal overall size, simple but rugged construction of few parts, yet such providing increased capability and greater safety and security in handling, receiving and raising horses and like animals.

Other and further objects of the invention will appear in the course of the following description thereof.

DRAWINGS

In the drawings, which form a part of the instant specification and are to be read in conjunction therewith, an embodiment of the invention is shown and, in the various views, like numerals are employed to indicate like parts.

FIG. 1 is a three quarter, perspective view of the device in question taken from the front and slightly above. The device is shown closed, with the strapping systems also shown engaged thereon, in full lines. In dotted lines, a showing is made of the side elements or members near the viewer pivoted 90° around its front attachment toward the viewer.

(a) The front and rear doors are shown pivoted open around their mountings;

(b) A portion of the floor of the device is cut away to better illustrate the base frame which receives the floor planking; and (c) In dotted lines, the side wall member on one side (the same side as in FIG. 1) is shown pivoted 90° to full open.

Figures 4, 5, 6, 7:
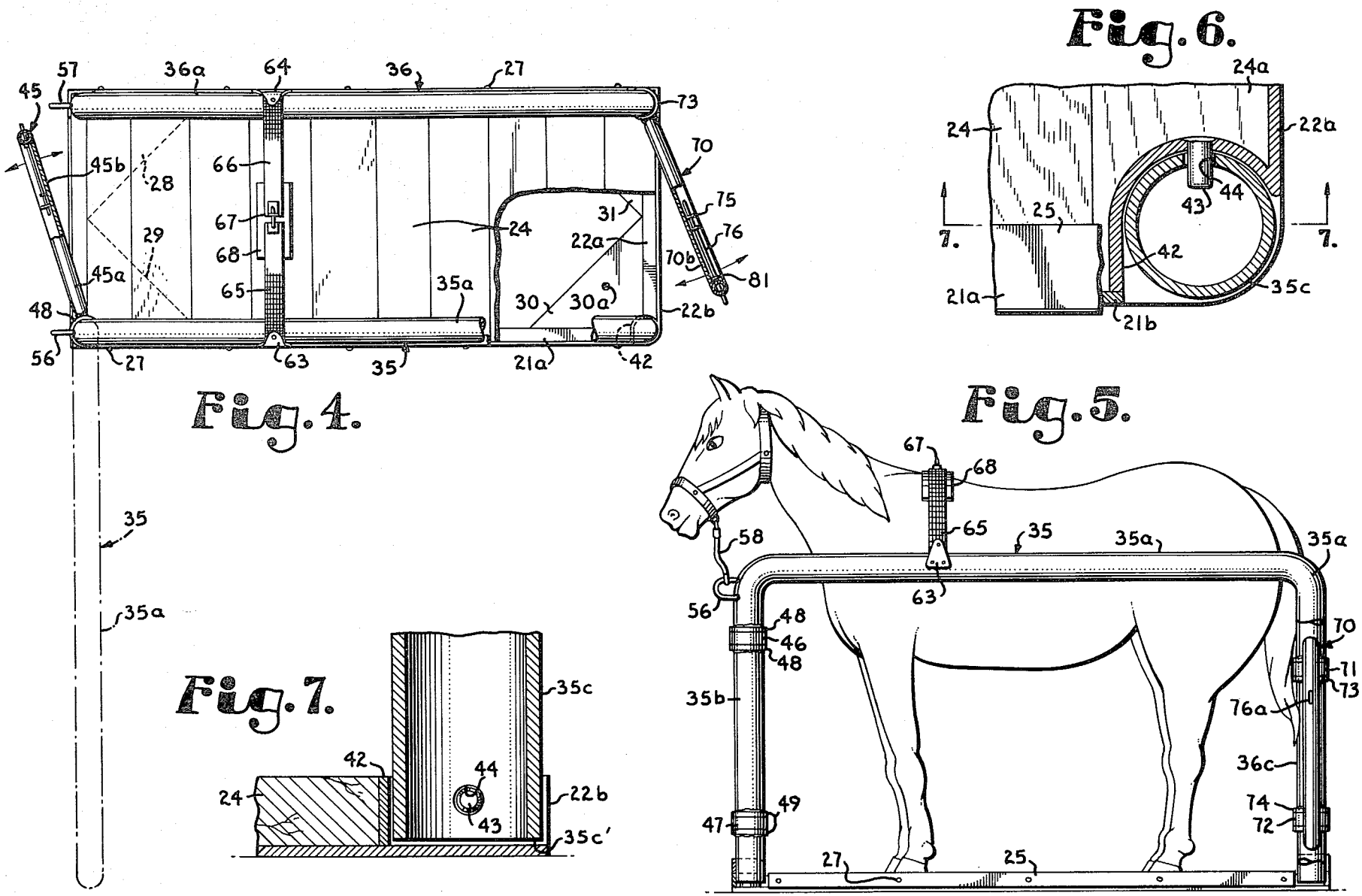
FIG. 4 is a top plan view of the device of FIG. 1 with the following additional changes.

FIG. 5 is a side view of the device of the previously described figures with a horse received therewithin and also tied into the device by the strapping system. All doors and elements are closed.

Figure 3:
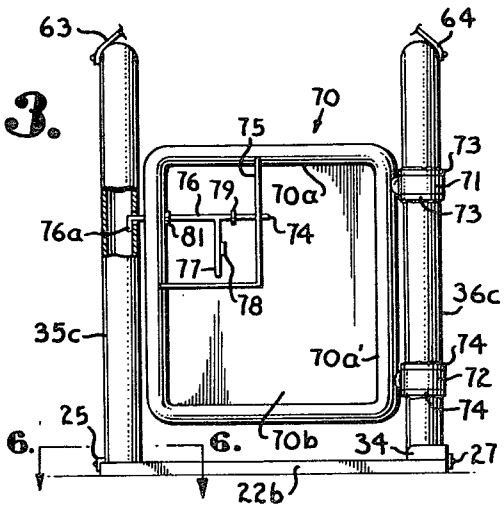
FIG. 3 is a rear view of the device of FIG. 1, taken from the right looking to the left in FIG. 1.

FIG. 6 is a view taken along the line 6—6 of FIG. 3 in the direction of the arrows.

FIG. 7 is a view taken along the line 7—7 of FIG. 6 in the direction of the arrows.

Figure 2:
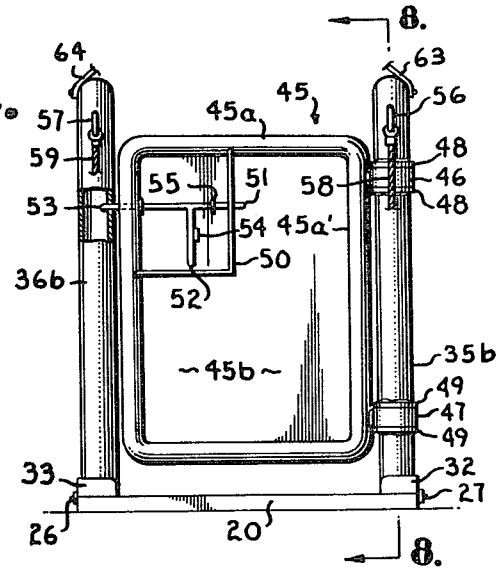
FIG. 2 is a front view of the device of FIG. 1 taken from the left hand end of FIG. 1 looking to the right in that view.
Figure 1:
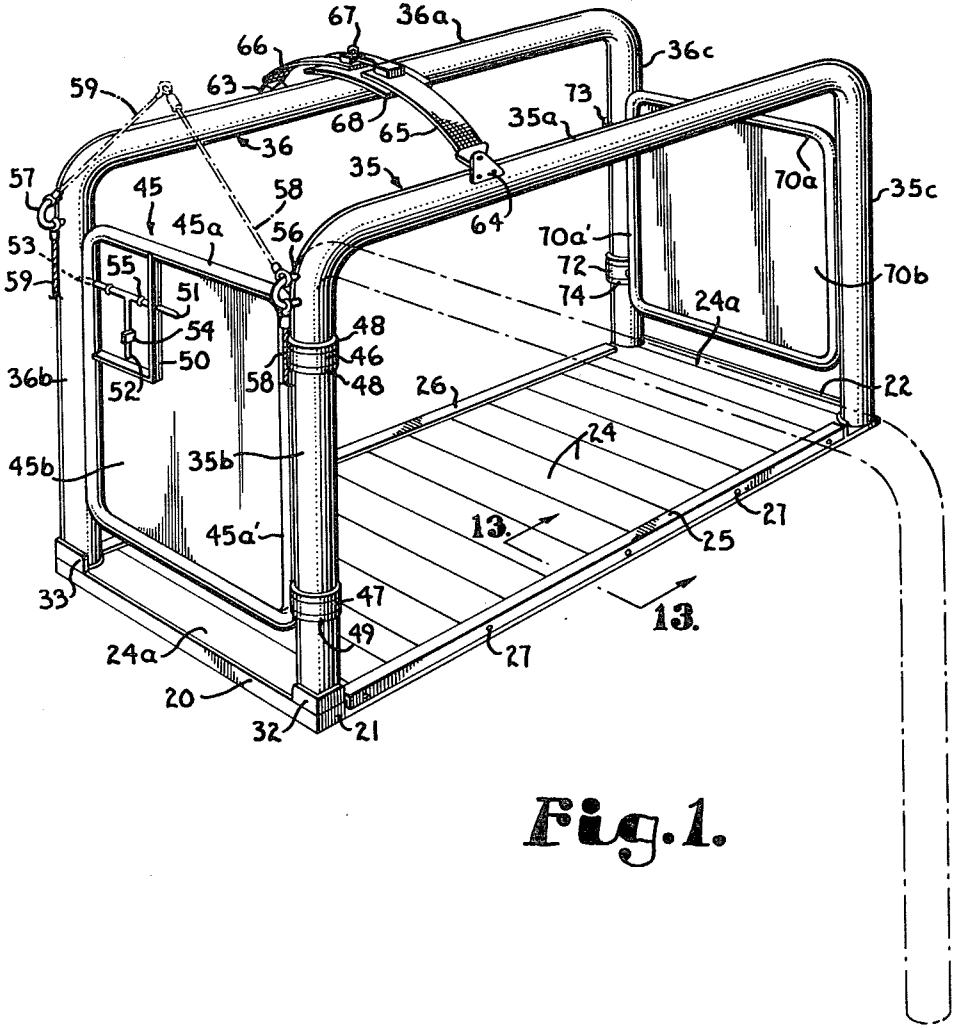
Figures 8, 9, 10, 11, 12, 13:
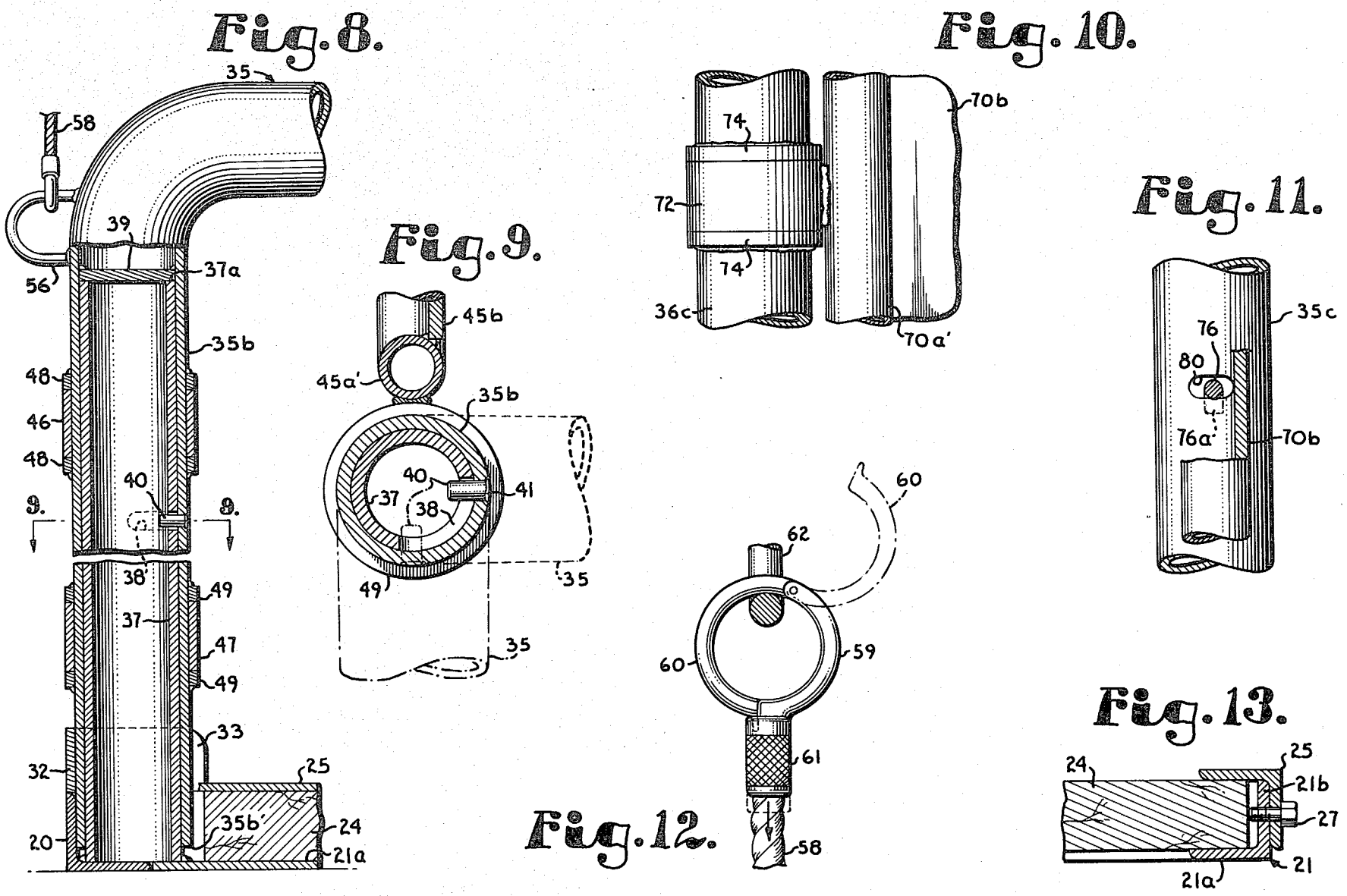

FIG. 8 is a view taken along the line 8—8 of FIG. 2 in the direction of the arrows (with respect to the front post mounting, particularly, of the pivotal side wall member seen pivoted in dotted lines in FIGS. 1 and 4).

FIG. 9 is a view taken along the line 9—9 of FIG. 8 in the direction of the arrows.

FIG. 10 is an enlarged detail of the collar mounting of the doors on the posts.

FIG. 11 is an enlarged detail showing the manner of engagement of the rear door with one post at the rear end of the device and also details the door construction to some extent.

FIG. 12 is an enlarged detail of one of the engaging rings of the front strapping system, showing one side thereof.

FIG. 13 is a view taken along the line 13—13 of FIG. 1 in the direction of the arrows.

Referring to the drawings, and first particularly to FIGS. 1, 4 and 13, the floor of the subject device is made up of four length of angle iron 20 and 22 (end pieces) and 21 and 23 (side pieces). These lengths of angle iron, as is best seen in FIG. 13, have flat lower portions 21*a*, etc. and right angle vertical portions 21*b*, etc. on which may be laid beam members 24. Beam members 24 are received on the lower, horizontal faces 20*a*–23*a*, inclusive of the angle iron side and end members and are removably fixed thereon by elongate, removable angle iron sections 25 and 26 removably boltable (FIG. 13) to the vertical edges 20*b*–23*b*, inclusive of the floor angle iron members 21–23, inclusive by bolts 27. The said angle iron members are dove tailed at the ends thereof and welded to one another at their corner attachments and, additionally, at the said right angle corner engagements have triangular gusset or base plates 28–31, inclusive rigidly welded or otherwise fixedly attached thereto to provide a strong, rigid, base frame to receive the beam members 24. Base plates 28–31, inclusive are preferably so sized and spaced so as to underlie and support the several beams at each end of the floor on which the tethered full sized horse's hoofs will be located as the animal stands in the frame or chute.

The angle irons 26 and 27 stop short of the corners and side post connections and engagements with the frame as will be described. The end beam members 24*a* on the floor are relieved at the corners thereof with respect to the post connections and engagements to the frame, to be described. Elevated corner pieces 32, 33 and 34 are provided at three of the corners, outboard of the posts in question, such welded rigidly to the tops of the angle iron vertical flanges of the side and end pieces. Members 33 and 34 are welded also to the bases of the post constructions thereat, but 32 is not welded to the post construction as will be described.

Turning to the side wall constructions first, be it noted that the left hand end of the view of FIG. 1 is the front of the device (with the posts carrying the larger gate thereon), with the right hand side of the view being the rear portion of the device (carrying the lesser size gate on the posts thereof. There are two inverted U shape sidewall members, generally designated 35 and 36. Member 35, close to the viewer in FIG. 1, has top, elongate horizontal portion 35*a* with vertical front post portion 35*b* and rear vertical post portion 35*c* integral with the ends thereof. The entire wall member 35 is preferably of hollow, strong steel pipe or tubing formed as shown in the views. The other wall member 36 likewise has top horizontal portion 36*a* and front and rear vertical portions 36*b* and 36*c*. The detailed construction of wall member 35 will first be described.

Looking first at FIG. 8, FIG. 8 is a sectional detail of the right front corner of FIG. 1, particularly detailing the structure within the vertical leg 35*b* of wall member 35 which enables that member to pivot as seen in dotted lines in FIGS. 1 and 4. Specifically, there is an elongate, hollow, vertical post 37 which is welded at its lower end to the lower flanges of angles 20 and 21 and, additionally, gusset plate 29. This post has a slot 38 in the intermediate side wall thereof over an arc of 90 degrees therein intermediate the upper and lower ends thereof, preferably just below the upper collar for the front gate to be later described. The vertical leg portion 35*b* of side wall member 35 fits over post 37 as a sleeve in rotatable sliding fit and has, provided therewithin, adjacent the upper end thereof, plate 39 welded or otherwise fixedly attached therewithin which rides on the top end 37*a* of post 37. The lower end 35*b*′ of front leg 35*b*, as can be seen in FIG. 8, does not reach the floor of the device and thus leg 35*b* is free to pivot on plate 39, while remaining rigidly located in vertical orientation by its sleeve engagement post 37. A steel pin 40 is mounted in the wall of leg 35*b* at the location of slot 38 and fits therewithin (being welded at 41 to leg 35*b*). Pin 40 can move 90 degrees in slot 38 in rigidly fixed post 37, thus from the full line positions of FIGS. 1 and 4 to the dotted line positions of FIGS. 1 and 4.

FIGS. 6 and 7 show the detail of engagement of the leg 35*c* with the corner construction of the frame. Note in FIG. 1 that the flange 21*b* of angle iron 21 is relieved at the corner portion. This permits vertical leg 35*c* to pivot out of the frame engagement. In FIG. 6, it may be seen that an arcuate wall 42 is provided interconnecting the vertical outer flange of rear end angle iron 22 with the vertical outer flange 21*b* of side angle iron 21. A pin 43 is welded to this wall and is adapted to engage an opening 44 provided in the lower inside end of vertical leg 35*c*. This prevents vertical movement of leg 35*c*. The latter's engagement and locking against pivotal movement when the rear door is closed will be later described. FIG. 7 shows the engagement of pin 43 and opening 44 with the lower end 35*c*′ of vertical leg 35*c* spaced slightly above the lower flange 21*a* of angle iron 21. The latter dovetails into the lower flange 22*a* of end angle iron 22 and is welded thereto, as well as to gusset plate 30. Each of the gusset plates 28–31, inclusive have, preferably, centrally thereof, at least one opening 30*a*, etc. (see FIG. 4) for bolting the frame to a concrete pad or any fixed floor.

It should be understood that the lower ends of legs 36*b* and 36*c* of the opposite wall member 36 are rigidly welded to the angle iron junctures and gusset plates at these corners, as well as the bracing flanges 33 and 34. Thus wall members 36 is rigidly fixed to the base frame and does not pivot or move, as is the case with its opposite member 35. Wall members 35 and 36, as may be seen, are inverted U shaped hollow pipes of great strength.

Turning now to the door constructions, the front door 45 may optimally be formed of a circumferential welded hollow pipe member frame 45*a* and a plate of steel or other strong metal material 45*b* welded or otherwise fixedly attached centrally thereof. A pair of ring collars 46 and 47 are welded or otherwise fixedly attached to one vertical frame side 45*a*′ and are rotatably received in rings 48 and 49 welded or otherwise fixed to the outer face of leg 35*b*. It should be noted that, while the front gate may pivot on its collars 46 and 47 with respect to leg 35*b*, the leg 35*b* may pivot within the collars to its dotted line positions of FIGS. 1 and 4 (or any position intermediate thereof) while the front gate 45 is fixed in position between front legs 35*b* and 36*b*.

A frame 50 may be attached to the outer face of door members 45*a* and 45*b*, thus to carry elongate rod 51 having handle 52 therein. This rod is pivotally received in openings through the vertical member of frame 50 and the opposite vertical tubing member 45*a* from that one (45a') carrying collars 46 and 47, thus to engage an opening 53 in the inner side of leg 36b to lock the gate into position between legs 35b and 36b, independent of the pivotal position of leg 35b. A stop 54 is provided on panel 45b to permit locking of handle 52 therepast to secure the engagement of the rod 61 and opening 53, while ring flange 55 is provided on rod 51 to limits its movement to the left in FIG. 2 when disengaging rod 51 from vertical leg 36b.

A pair of loops 56 and 57 are fixedly welded or brazed to the front upper ends of legs 35b and 36b (the former when in the full line positions of FIGS. 1 and 4) thus to provide engagement for any suitable quick release (conventional) halter attachments such as ropes or straps 58 and 59, respectively. A typical but not limiting end connection for a quick release center halter engagement is seen in FIG. 12, with rope or strap 58 having at its center free end an engagement comprising a rigid base loop member 59 to which is pivoted snap-in arcuate member 60. The latter is engageable and disengageable from a lengthwise slideable sleeve 61 to provide quick engagement and disengagement from halter ring 62. This is a conventional construction and various engagements can be provided. Thus, the quick engagement may be provided at the ring 56 or centrally of the straps or ropes 58 or 59, or both depending upon the operator's or handler's choice. Both engagements at the ends of straps 58 and 59 may be conventional releasable catches of any strong, dependable, conventional construction, as well.

Curved, metal, strong strap base members 63 and 64 are provided on top beams 35a and 36a at a position fairly closely adjacent the front end and front gate of the subject device whereby, when an animal or horse (as in FIG. 5) is positioned within the frame, an engagement may be made over the back of the horse just to the rear of the wither zone or area. Connected to the rigidly attached base members 63 and 64 are relatively flexible belts 65 and 66 which have, preferably, a quick engagement and release mechanism 67 of conventional type provided centrally thereof. The release construction and ends of belts 65 and 66 are underlaid, preferably, by a flat, leather plate or band 68 operative to protect the horse's back, should the horse attempt to rear, maneuver or back strongly within the frame, once positioned and engaged or tied therein.

Now referring to the rear gate, particularly seen in detail in FIG. 3, as well as FIGS. 10 and 11 and the right hand side of FIG. 5, the rear gate is generally designated 70 and is again of the outer pipe frame 70a construction with center metal plate 70b rigidly fixed therewithin. Collars 71 and 72 are welded or otherwise fixedly attached to pipe section 70a', these collars being rotatably, but fixedly, received between bands or rings 73 and 74 rigidly fixed or welded to rear leg 56c of the rigid, U form side member 36. Gate 70 can pivot a full 360 degrees around the leg 36c on collars 71 and 72.

A locking frame and engaging means is provided on gate 70 analogous to that seen in the upper left corner of FIG. 2, comprising frame 75, rod 76, handle 77, stop 78 and ring stop 79. The engagement of rod 76 in leg 35c, however, differs from the engagement of rod 51 within opening 53 and leg 36b. Specifically, a slot 80 (FIG. 11) is provided in the inboard wall of vertical leg 35c adapted to receive the right angled engaging tip 76a of rod 76 therewithin. FIG. 11 shows the positive engagement made (as in the case of FIG. 3) which not only locks gate 70 between legs 36c and 35c, but also holds, rigidly and fixably, leg 35c in the position of FIGS. 6 and 7, as well as the full line positions of FIGS. 1 and 4, preventing any pivoting of the side wall member 35. It has additionally noted that rod 76 has an additional stop 81 on the left side of handle 77 (in FIG. 3) which prevents rod 76 being pulled through the pipe 70a by any force exerted on wall member 35 by the animal in its motion in the device when the animal is captured, in place and strapped in or therebefore, once the gates are closed.

The mode of operation of the subject device will now be described in detail with respect to the foregoing described parts in their relationship to one another, structurally and functionally.

USE AND OPERATION

Out of use or in storage, the device is in the position of FIGS. 1–3, inclusive with the pivotable sidewall member 35 positioned parallel to wall member 36. The engagement member 76a on rod 76 in the rear gate attachment fully and lockingly engages leg 35c opposite to and parallel with leg 36c by the engagement detailed in FIGS. 3 and 11. With this engagement being the case, the pin 40 (FIGS. 8 and 9) is in the full line position of FIG. 9 with top beam 35a parallel to top beam 36a. Pin 43 is firmly received in opening 44 in the lower leg portion 35c with leg portion 45c abutting against arcuate receiver 42. It is also assumed that the device is fully assembled with the floor beams 24, 24a locked into position on the angle iron bases and gusset plates by the overlying bolt-on angle irons 25 and 26.

In order to accommodate a horse in the device in question, various approaches, depending on experience with the animal and its idiosyncrasies, may be employed. With a calm, experienced animal, the rear gate may merely be opened and the animal led into the opened rear end of the chute, up to the closed front door thereof and the initial tiedown made at the front with the halter of the animal as seen in FIG. 5. The wither belt, which would have been disengaged and laid back before the horse entered the stall, would then be engaged over the animal's back. The rear gate would be closely and fully and lockingly engaged.

As an alternative approach, some animals can be backed into the open front gate, the rear gate being secured in locking manner, the horse backed in the desired distance, the front door closed and the front connection made with straps 58, 59 at rings 56 and 57 from the halter. Thereafter the wither strap is overlaid over the animal. In these cases, no extraordinary action need be taken except skillful animal handling with a cooperative horse.

On the other hand, it is often the case that neither of these approaches will work or suffice. In such case, the rear gate latch 76a is engaged through rod 76 and handle 77 (raising the latter). The rear gate is freed from vertical leg 35c of the pivotal wall member or the inverted U side beam member 35. This member then may be pivoted out 45°, 60° or even 90° as seen in FIGS. 1 and 4. With the full side of the device thus opened, the horse handler then may lead the animal by the halter or bridle in toward the platform, moving from rear to forward and further leading the animal's head toward the front gate, which remains closed, despite the displacement of the one side wall member 35. The handler leads the animal up to the front end and forwardly so that the animal's front feet go up onto the platform and (provided frame is fixed to a solid base) the initial front engagement with loops or rings 56 and 57 may be made with the halter. If the frame device is not fixed to a base, halter securement awaits full closure of the frame around the animal. At this time, with the animal not fully in the stall, the handler can grasp the pivotal wall member 35 as he stands at the shoulder of the animal. Then, as he walks rearwardly down the length of the animal, first pushing the front shoulders, then the body, then the rear quarters of the animal latterally up on the platform, he can pull shut the gate member 35 with him as he moves and ultimately into the position of the full lines of FIGS. 1 and 4. At this point, the rear gate can be engaged in the manner seen in FIG. 3 to lock the animal in. The wither belt may then be applied to secure the animal in the desired position.

When the foregoing latter operation is handled in easy, casual manner with the gate initially so open, it is a considerable time before the animal even realizes that it is in the process of being confined. This is often not realized until the side wall is fully in place and the rear gate engaged therewith. At all times in this process, the horse handling can be done as easily and gently as desired and the timing of moving of the horse forwardly and laterally onto the platform, as well as pulling the side closure around, is timed according to the best judgment of the handler who is at the side of the horse, working with it and moving it laterally up on the platform.

The purpose of utilizing the wither safety belt once the front tiedowns are on is to prevent the animal rearing up and being able to throw itself out over the back door, particularly if the front tiedown should snap or break. It is noted, in this device, that there is nothing for the horse to hit with its head or rump if rearing. There is also very little, indeed no, upper structure overlying the animal at any time which top structure tends to spook or scare horses. Any and all types of protruding hinges, elements, connections, collars, engagements and the like are bad in animal confinement and handling because, under difficult circumstances, it is possible for an animal to seriously injure itself, put an eye out or even kill itself. It is most desirable that the front door be positioned low enough with respect to the floor that the horse's feet cannot go thereunder if the horse should fall within the stall for some reason. The gate structure illustrated may be made longer to provide this feature.

Thus it may be seen that the subject device is a unique, new horse chute engineered for safety and convenience permitting controlled trimming, washing, treating, palpating and worming of the animal. This device is specifically designed for horses and particularly in order that one person may handle the entire securing operation with total consideration for the safety of both the horse and handler.

Basically, steel pipe sides, typically three and one half inches in diameter, are connected at each end of the device with one quarter inch steel plate gates. The one steel pipe side or siderail swings open a full 90 degrees. The gates open to 180 degrees and close, both with a convenient, secure handle. All corners and edges are rounded to protect the horse. The plank floor is easily replaceable upon excessive use. The entire device can be bolted to a cement pad or used as a portable chute in the field by mounting it to an optional, wheeled frame. The unique strapping system includes a double tether in front and an adjustable wither strap tiedown, both of which snap quickly and securely with conventional strap engagements.

Optimum dimensions include the following, which are not limiting. Three and one half inch outer diameter steel tubing is employed for the main side members. The total overall length of the device may be eighty and one quarters inch. The internal length of the device within the end beams may be six feet one inches. The overall height of the device from ground level to top of the horizontal beams may be three feet eleven inches. Internal width between the parallel wall members may be two feet four and three quarters inches. Overall outside width may be three feet. A four inch clearance may be had under the rear gate. Three and a quarter inch clearance may be had under the front gate. Base frame greatest width may be three feet one quarter inch.

Snap-in side bars may be provided for ponies and foals. The device may be provided in special custom sizes. Nonslip rubber flooring may additionally be provided. Vet trays are an additional option.

The subject device keeps a horse received therewithin immobile, eliminating rearing, striking and kicking. The breakaway side and front and back gates, all of which swing open a full 90 degrees, allow a horse to be led in and double tethered, with recommended quick release tiedowns, swiftly and without fear on either side, horse or handler, which is a helpful experience for uneasy loaders, too.

Another feature of the subject device lies in that, if a horse should go down in the chute, in whatever manner or by whatever circumstance, the animal can be released very quickly, with safety to the operator. Specifically, the side member 35 can be reopened so that the horse is free to get up without panic because he is no longer confined. This will obviate the danger of breaking legs or otherwise injuring the animal, particularly since there is not present a maze of side bars as is the case in some typical prior art devices.

Further, with respect to brining an animal into the chute, as previously set forth above, unless the chute is securely bolted or fixed to the chute, a concrete pad or flooring, the animal should not be tied to the chute in any way until all sides engaged are securely latched and closed. If, on the other hand, the chute is firmly secured to the ground, a floor or a concrete pad, the horse can be tied to the front ring while loading, with the side wall open and the rear gate open. The point is that, if the device is not secured to a floor, pad or the ground base on which it is mounted, the horse or animal could be injured by having it tied to the chute with the animal's feet still outside of the chute because, if the (powerful) animal panicked, it could pull the chute to one side or worse. Once the animal is locked inside the chute, however, with its feet on the floor of the chute, this hazard does not exist and the animal can be tied in, first at the front and then with the wither strap.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. An animal confining stall or chute comprising, in combination, a substantially rectangular base floor having a greater length than width and front, rear and side ends and edges, a pair of first and second inverted U-shape side wall members each having a normally horizontal elevated U-base and normally vertical U-legs, said members mounted at opposed sides and adjacent the ends of the base floor, with the legs of the first one of the members rigidly fixed to the base at the lower ends thereof and adjacent two corners of the base on one side edge, whereas to provide a fixed side wall at one side edge of the base running the substantial length thereof, the elevated U-base of the said first inverted U shaped member running substantially horizontally the substantial length of the base floor at the said one side edge thereof and spaced upwardly therefrom a substantial height by the normally vertical legs of the U, a normally vertical post fixed at one corner of said floor opposite said first fixed side wall member and extending a substantial height above said floor, said post received in one leg of the second U-shaped side wall member in such manner that the said second side wall member is able to pivot on said post from a position on and over said base floor substantially parallel to said first side wall member to a substantial outward angle to the second side edge of said floor free of said floor in the substantial length thereof, a front gate pivotally mounted on the leg of said second side wall member which is mounted on said post, said front gate removably engageable with one leg of the first inverted U-shaped side wall member to fixedly close said gate in reopenable fashion, and a rear gate pivotally mounted on the other leg of said first inverted U-shaped side wall member and having means associated therewith to fixedly engage and disengage with the U-member leg of the second side wall member which is not received on said post, in such manner as to not only fix said rear gate between said side wall members at one end thereof, but also to releasably fix said second side wall member in position with respect to said base floor and second side edge thereof in such manner as to be positioned on and over the base floor substantially parallel with said fixed first side wall member fixedly mounted on said base floor, when said rear gate is closed and engaged.

2. A device as in claim 1 including means on the ends of said side wall members adjacent to but above said first gate for tying a front end animal tether thereto.

3. A device as in claim 2 wherein said latter tether tying means comprises a pair of loops, one fixed adjacent the top end of each front gate engaging leg of a side wall member.

4. A device as in claim 1 including wither strap means communicating between the base lengths of the inverted U shaped side wall members intermediate the ends thereof but closer to the front gate mounting portion thereof, whereby to releasably overlie the withers of an animal received in the stall.

5. A device as in claim 1 wherein said floor is made up of right angle, end connected, upwardly opening angle irons at the side edges and ends thereof adapted to receive planks thereon, there being substantially triangular gusset plates fixed to the corners of said angle irons to underlie some of the planks and fix said angle irons rigidly with respect to one another, there also being means for removably holding and fixing said planks with respect to said angle iron and gusset plate base construction.

6. A device as in claim 5 wherein said latter means comprises separate, downwardly opening angle lengths adapted to bolt to the side extremity of each side edge angle iron in removable fashion.

7. A device as in claim 1 wherein said front gate is of greater height than said rear gate.

8. A device as in claim 7 wherein said front gate extends substantially the entire height of said side wall member, yet is limited in height below the topmost portion thereof.

9. A device as in claim 1 including an arcuate recess formed in the end and side angle irons receiving the lower portion of the outwardly movable leg of the second side wall member, whereby to limit the inward pivot thereof over said base floor.

10. A device as in claim 9 including a positioning peg fixed to said arcuate recess wall formed by the end and side angle irons receivable in an opening in the lower end of the second side wall member leg which is outwardly movable.

11. A device as in claim 1 wherein the side wall members are of substantial equal height.

12. A device as in claim 1 including a platform in the post engaged second side wall member leg which pivotally rests on said post top end, thus spacing the lower end of said leg upwardly from the base of the post.

13. A device as in claim 1 including means for limiting any downward pivot or canting on said second wall member.

14. A device as in claim 13 wherein said means comprises a slot in said post wall engaged by a peg fixed to said post engaged leg of said second member.

* * * * *